United States Patent [19]

von Gerlach

[11] Patent Number: 4,953,466

[45] Date of Patent: Sep. 4, 1990

[54] PROPULSION CAGE FOR A SUBCALIBER PROJECTILE

[75] Inventor: Johann von Gerlach, Bergisch Gladbach, Fed. Rep. of Germany

[73] Assignee: Dynamit Nobel Aktiengesellschaft, Troisdorf, Fed. Rep. of Germany

[21] Appl. No.: 334,367

[22] Filed: Apr. 7, 1989

[30] Foreign Application Priority Data

Apr. 7, 1988 [DE] Fed. Rep. of Germany ..... 3811597

[51] Int. Cl.[5] ..... F42B 14/08

[52] U.S. Cl. ..... 102/521

[58] Field of Search ..... 102/520–523, 102/703

[56] References Cited

U.S. PATENT DOCUMENTS

| | | | |
|---|---|---|---|
| 4,469,027 | 9/1984 | Burns et al. | 102/521 |
| 4,524,695 | 6/1985 | Bisping et al. | 102/520 |
| 4,651,649 | 3/1987 | Nussbaum | 102/523 |
| 4,702,172 | 10/1987 | Wallow et al. | 102/521 |

FOREIGN PATENT DOCUMENTS

| | | | |
|---|---|---|---|
| 152492 | 1/1984 | European Pat. Off. . | |
| 3033041 | 3/1982 | Fed. Rep. of Germany . | |
| 2836963 | 3/1984 | Fed. Rep. of Germany . | |
| 143675 | 1/1954 | Sweden | 102/521 |

*Primary Examiner*—Harold J. Tudor

*Attorney, Agent, or Firm*—Antonelli, Terry, Stout & Kraus

[57] ABSTRACT

A propulsion cage usually constructed from three segments, intended for a subcaliber projectile is designed so that a surface exposed to the propellant gases is extended preferably in the shape of a truncated cone with the apex toward the rear up to the end of the subcaliber projectile. Force derived from the propellant gases can be transmitted in uniform distribution practically over the entire surface of the subcaliber projectile. At the same time, transmission between the propulsion cage and the subcaliber projectile is enhanced so that the entire propulsion cage can be manufactured from a fiber-reinforced synthetic resin, so that there is no absolute need for providing additional shape-mating transitions between the propulsion cage and the subcaliber projectile, and so that yet a very high propellant gas pressure can be utilized. Preferably, each segment exhibits wedge-shaped cavities open in the firing direction which are filled with cores. Plate-like members between the segments are likewise of advantage.

11 Claims, 4 Drawing Sheets

PROPULSION CAGE FOR A SUBCALIBER PROJECTILE

BACKGROUND OF THE INVENTION

This invention relates to a propulsion cage which can be separated into segments and which is in shape-mating relationship to a subcaliber projectile; the cage exhibiting a forward guide zone and a propulsion zone with a driving surface, the profile of the driving surface approaching the peripheral area of the subcaliber projectile with constant tapering, starting with the guide zone.

In order to fire a subcaliber projectile, a propulsion cage is utilized, the cage transmitting essentially the pressure of the propellant gases to the subcaliber projectile for acceleration and serving as a guide for the subcaliber projectile within the barrel of a weapon. The propulsion cage for a subcaliber projectile is a rotationally symmetrical member subdivided into (usually three) segments by separating cuts so that the cage disintegrates after leaving the barrel of the weapon and drops off the subcaliber projectile.

A conventional propulsion cage (De 3,033,041-A) exhibits a guide zone, for example in the form of a forward guide plate, and a propulsion zone, in most cases also in the form of a rearward driving plate, and thus approximates the shape of a dog's bone, i.e. a bone with joints on proturbances at each end.

The kinetic energy which can thus be transmitted to a subcaliber projectile is limited due to the properties of the material of the subcaliber projectile. The stresses that occur must be influenced by the structure of the cage and an energy transmission is possible which is the higher, the lower the maximum compressive strains and tensile stresses caused by the propellant gases in the zone of the transmission surface to act on the subcaliber projectile. At the level of the driving plate, the tensile stress in the subcaliber projectile has the highest value; this stress changes over in the rearward direction toward the stabilizer into a compressive strain region; a compressive strain region likewise occurs once again toward the tip of the subcaliber projectile, due to the mass distribution in the forward zone of the subcaliber projectile.

In DE 2,836,963-A and EP 152,492-A, a sabot cage has been modified so that, in place of a driving plate, the driving surface has been spread apart in the axial direction, and the driving surface exhibits a sagging profile approaching the outer edge of the peripheral region of the projectile. The propellant charge cage encompasses approximately half the projectile. On account of the configuration of the driving surface, the shape-mating coupling between the projectile and the propulsion cage is improved, and the mass proportion of the propulsion cage is reduced. With such a configuration of the propulsion cage, the part of the projectile no longer surrounded by the driving surface can be torn off; the maximum propellant gas pressure is thereby limited.

The invention is based on the object of designing a maximally lightweight propulsion cage for a subcaliber projectile having such a structure that a maximally high propellant charge pressure can be utilized for the acceleration of the subcaliber projectile.

In order to attain this object, a propulsion cage is proposed in accordance with the invention which is characterized in that the driving surface extends from a forward guide zone to an end region of the subcaliber projectile.

It has been found surprisingly that a relatively lightweight propulsion cage of a synthetic resin can satisfy all requirements.

The introduction of force into the subcaliber projectile is distributed, by the propulsion cage according to this invention, practically uniformly over the entire jacket surface of the subcaliber projectile Thereby, the maximum values recede, and the stress curve in the propulsion direction becomes substantially more uniform. The occurrence of merely compressive strains, and of hardly any tensile stresses, can be achieved. With an identical transmission surface area, it is possible, for example, to more than double the force transmission from the propulsion cage to the subcaliber projectile with a conical contour of the propulsion cage as compared with a cylindrical contour.

In conventional propulsion cages similar to a dog's bone, the rearward, sealed driving plate also performs a guiding function within the barrel. In case of very long projectiles, equal-caliber stabilizers and/or radially projecting protuberances are required in most instances, according to EP 192,492-A. With the propulsion cage according to this invention, the plane of the centers of gravity of the driving surfaces already lies in the very close proximity to the center of gravity of the subcaliber projectile and the propulsion cage combined so that, if at all, little-stressed stabilizers are adequate, such as, for example, guide ribs at the rear end of the propulsion cage; in general, a sufficiently stable acceleration in the barrel is possible even without such additional guide elements. An improvement in the projectile stability is achieved.

In the propulsion cage according to the invention, the compressive strain occurring in the rearward zone of the subcaliber projectile is substantially identical to the static compressive strain which cannot be reduced any further on account of the gas pressure of the propellant charge. In contrast thereto, based on this structure, tensile stresses can be extensively avoided in the entire extension of the subcaliber ammunition, and the stress curve is generally low and smooth.

Although the propulsion cage of this invention permits very high propellant gas pressures, it is possible to manufacture this cage entirely of a synthetic resin, preferably from a carbon-fiber-reinforced synthetic resin; a preferred synthetic resin is epoxy resin. It has been found surprisingly that, on account of the rather uniform contact pressure over the entire surface of the subcaliber projectile, a flawless, high force transmission can be brought about from the propulsion cage to the projectile without the need for providing additional auxiliary means at the propulsion cage. Such conventional auxiliary means are, for example, a (separable) metallic sleeve within a propulsion cage of plastic, or mutually corresponding uneven areas between the projectile and propellant charge such as, for example, a thread cut into the projectile to provide longitudinally axially acting shapemating connection.

It may be advantageous, above all for reasons of manufacturing technique and/or engineering, to design a propulsion cage of a synthetic resin according to this invention so that it is not solid but rather has a ribbed, forwardly open structure. The thus-formed cavities must be filled out with corresponding cores of the same material or other materials on account of the required high compressive strength. Therefore, it is advantageous to fashion cavities in a wedge-like shape. Such cores are retained in their position due to mass moment of inertia during the acceleration phase of the subcaliber projectile. Such segments with thinner walls exhibit higher strength values, and possible problems in heat removal and shrinkage during manufacture can be more readily avoided. Another important advantage resides in that, by a special choice of material for the cores to be inserted, the properties of the propulsion cage as a whole can be still further improved. The properties of high-strength anisotropic materials can be optimally exploited for the skeleton of the segments of the propulsion cage as well as for the cores to be inserted.

It is especially advantageous to fill the cavities in the segments of the propulsion cage with wedge-shaped and platelike elements, the axis of the subcaliber projectile lying in the plane of the plate-like elements.

The plate-shape preferred for filling the cavities is to be imposed on the segmented propulsion cage also in still another form, namely by providing plate-like components between the individual segments of the propulsion cage, the mechanical property values of these components being optimized in the direction toward transmitting a maximally high propellant gas pressure to the subcaliber projectile. The increased manufacturing expenditure is not of very great significance inasmuch as the manufacture of anisotropic plate-shaped parts is relatively simple. Preferably, the plate-shaped parts are inserted in the cores and/or between the segments which are made of material with unidirectional fibers; whereas fiberfilled molded compositions are utilized for the wedge-shaped cores, or also for the segment skeleton.

Especially in case of plate-shaped elements for the cores, or plate-like components between the segments, it is possible to mold thereto, during manufacture, areas which act as flow-exposed surfaces in the propulsion cage and promote disintegration of the propulsion cage after exiting from the barrel.

BRIEF DESCRIPTION OF THE DRAWINGS

The invention is illustrates in the accompanying drawings by way of embodiments and is hereinafter described with reference to the drawings wherein.

DETAILED DESCRIPTION

Figure 1:
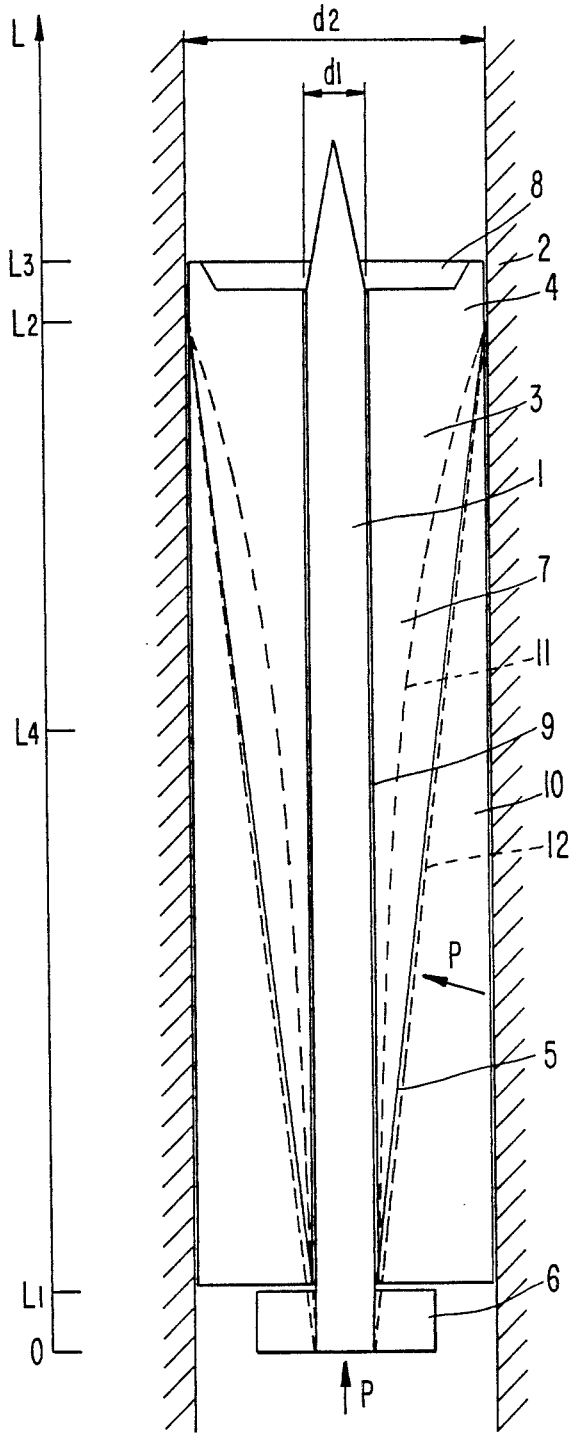
FIG. 1 is a partial sectional view of a barrel of a weapon containing a preferred embodiment of a propulsion cage with a subcaliber projectile.

According to FIG. 1, a subcaliber projectile 1 having a diameter $d_1$ is to be fired with the use of a barrel 2 having a diameter $d_2$. The propulsion cage 3 effects sealing of the powder gases (here indicated by arrows P), brings about force transmission to the subcaliber projectile 1, and also takes over the guidance within the barrel 2.

The propulsion cage 3 is a rotationally symmetrical body made up of three segments. Its forward region (as seen in the firing direction) is constituted by a guide plate 4. According to this invention, the driving zone includes a driving surface 5 extending practically up to the end of the subcaliber projectile. This driving surface has the effect that maximally high acceleration forces can be introduced into the subcaliber projectile 1, with adequate radial pressure, distributed practically over the entire length of the subcaliber projectile.

In the propulsion cage 3, the guide zone defined by plate 4 and the driving zone defined by surface 5 practically abut each other; the guide plate 4 is followed by a member 7 having a shape similar to a truncated cone. The entire propulsion cage 3 is formed from three segments. Due to a baffle surface 8 on the end face of the guide plate 4, the propulsion or driving cage 3 is detached along the seams 9 from the subcaliber projectile 1 when leaving the barrel on account of the high velocity (>1,000 m/sec). In order to couple the propulsion cage 3 to the subcaliber projectile 1 along the seam 9, frictional forces alone are generally sufficient; if necessary, grooves, threads, or shoulders can improve force transmission even further.

The propulsion cage 3 can consist entirely of reinforced synthetic resin. The contour of the driving surface 5 of the driving zone has, in this embodiment, the shape of a truncated cone. The propulsion cage 3 extends to the stabilizer 6 of the subcaliber projectile 1. The center of gravity of the driving surface is located to a large extent in the forward direction on account of this configuration, so that additional guidance in the rearward zone, heretofore of great importance especially with a disk-shaped driving surface, becomes less important; frequently, such additional guidance can even be entirely eliminated. In this example, several radially projecting ribs 10 are provided.

Figure 3:
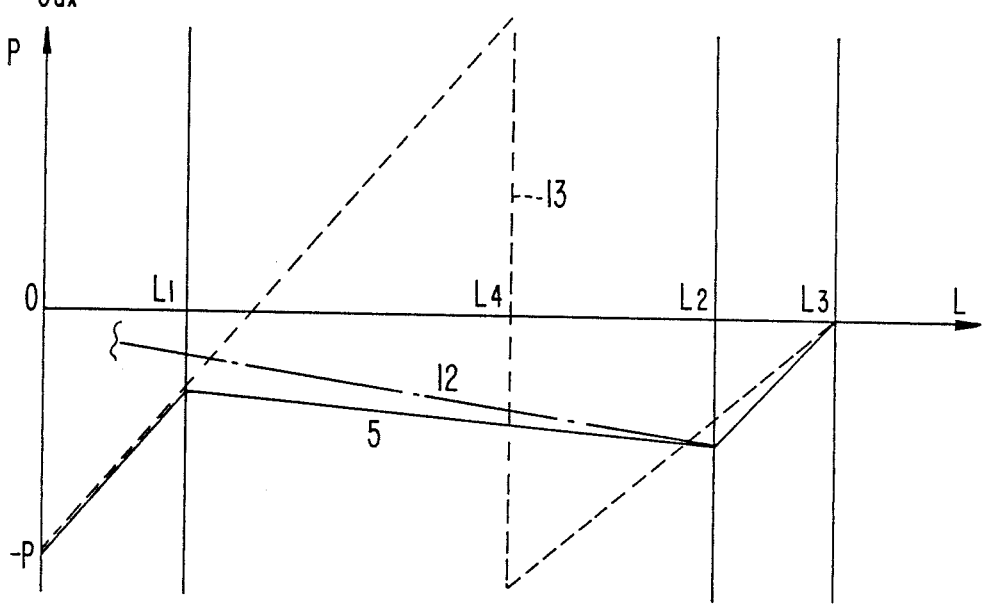
FIG. 3 shows the stress curve in the axial direction of the subcaliber projectile.

FIG. 1 shows two lines 11, 12 in broken form; these broken lines are to indicate two further possible embodiments of the driving surface, referred to in FIG. 3. The contour 11 indicates that the generatrix of the driving surface 5 need not necessarily be a straight line but rather can also curve in a concave or convex fashion; in this arrangement, a strongly monotonous, constant increase of the diameter is to prevail in the firing direction. In case of the configuration of contour 12, the driving member 7 extends to the stabilizer 6 of the subcaliber projectile 1. This contour likewise need not absolutely be linear. On account of the stabilizer 6 at the subcaliber projectile 1, a driving member 7 extending to the end of the subcaliber projectile 1 or even further past the projectile requires a somewhat more expensive manufacture; it has been found that a driving member 7 which extends only up to the stabilizer 6 or into the stabilizer also comes still very close to optimum driving conditions.

Figure 2:
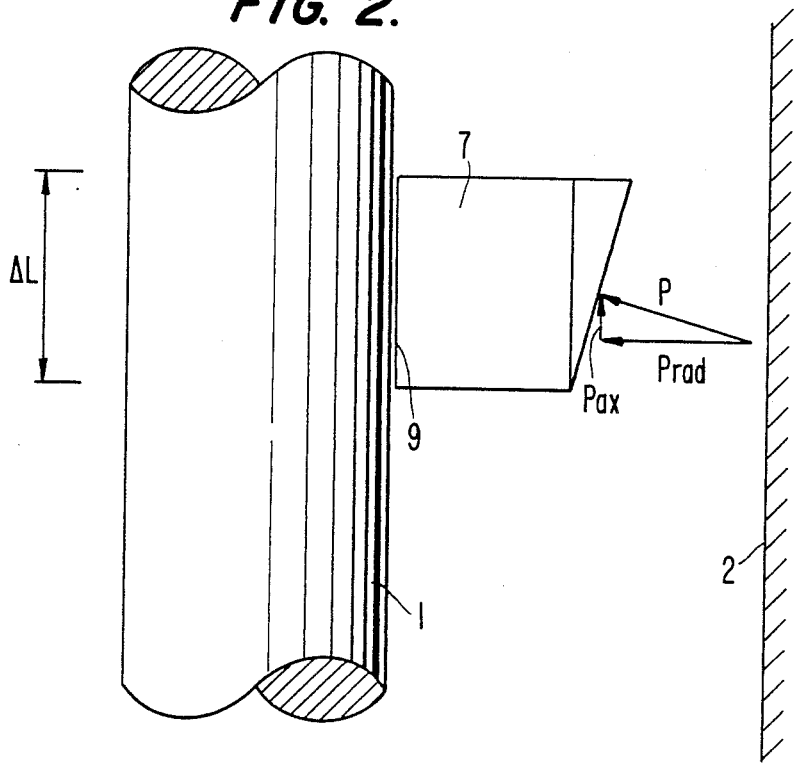
FIG. 2 shows the force distribution on the driving surface of the propulsion cage (fragmentary view)

FIG. 2 is a schematic illustration to clarify that in case of a linear contour of the driving surface 5 as in FIG. 1 the force $P_{ax}$ can be introduced by the propellant charge gases p extensively uniformly over the entire length of the subcaliber projectile. The thrust force exerted on each annular element $\Delta L$ is affected, besides being influenced by the gas pressure P, also by the weight of the subcaliber projectile and of the propulsion cage. In addition to the axial component, a radial component $P_{rad}$ also occurs herein in all cases and acts practically over the entire surface of the subcaliber projectile, and, consequently, a very great force can be transmitted solely by friction.

The stress cure along the subcaliber projectile is shown in schematic simplification in FIG. 3. With a driving surface 5 having the shape of a truncated cone, the pressure p caused by the propellant gases produces a compressive strain at the end of the subcaliber projectile (schematically characterized by -P) which diminishes to $L_1$ and then, according to driving surface 5 in FIG. 1, exhibits only a weakly negative or positive value. For comparison purposes, the stress curve is illustrated in dashed lines (13) as it would occur if at the level of $L_4$ the propellant gas pressure were to be introduced into the propulsion cage by way of a disk. In such a case, a very high stress peak would arrive at $L_4$; closely therebehind, negative stresses (compressive strains) would again have to be expected because the forward region of the subcaliber projectile exerts pressure at this point. Because of the high peaks and the high gradients of the stress curve, the stress on the material of the subcaliber projectile would here be very critical. A stress curve corresponding to the contour or line 12 in FIG. 1 is also illustrated, using the reference numeral 12, in FIG. 3. The curve is very smooth; tensile stresses can be avoided entirely.

Figure 4:
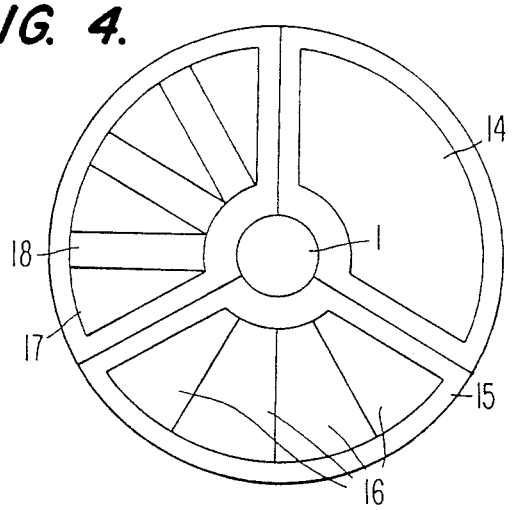
FIG. 4 is a top view of the frontal side of another embodiment of a propulsion cage with wedge-like cavities and the filling of the cavities with two different types of cores.

FIG. 4 shows a top view from the front of a subcaliber projectile 1 surrounded by a propulsion cage provided with cavities 14 and separable into three parts. Each of these segments has a cavity 14 constantly tapering toward the stabilizer 6. In the propulsion cage, each cavity 14 is filled with a usually multipartite core; the material of the skeleton 15 of a segment need not be identical to the core material. Also the core proper can consist of variously shaped elements, also of differing materials. FIG. 4 presents two embodiments: on the one hand, the core consists of four elements 16 very similar to the "large" propulsion cage segments; however, the version with two different types of core elements 17, 18 is preferred. Plate-shaped elements 18 are high-strength synthetic resin components with unidirectional fibers; the wedge-shaped elements 17 consist preferably of molded compositions filled with chopped fibers. The fibers in the platelike elements 18 should run in several layers in the radial as well as axial directions. It is also possible to provide layers extending inclined thereto by 45°, or perpendicularly to the contour 12 of the cage. It is understood that the core elements 16, 17, 18 normally must be machined above all in the radial zone so that an adequately high, uniform compressive strength of the synthetic resin propulsion cage remains ensured.

FIG. 5 again illustrates merely schematically that plate-shaped elements 20 can also be included between the customarily three large segments 19 which latter, in turn, can exhibit core-filled cavities as in FIG. 4, which here is not separately illustrated. These plate-shaped elements 20 extend from the outer surface of the propulsion cage to the subcaliber projectile 1. In case the segments 19 contain radially extending boundaries 21 (shown on the left-hand side in FIG. 5), then wedges 22 similar to wedges 17 in FIG. 4 are additionally required. However, the segments 19 can also be shaped in such a way, as illustrated by the line 23 on the right-hand side in FIG. 5, that no additional parts are needed between the plate-like elements 20 and the segments 19.

Figure 5:
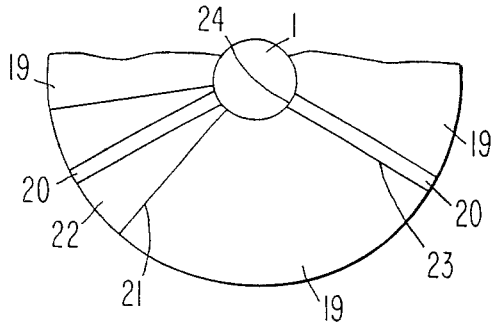
FIG. 5 is a top view of the frontal side of yet another embodiment of a propulsion cage with continuous plate-like components between the segments.

A configuration of the propulsion cage in accordance with FIG. 5 permits an even better force transmission to the subcaliber projectile; in this arrangement, the above-mentioned grooves or threads can furthermore be provided as well in the transition zone 24 from the plate-shaped elements 20 to the subcaliber projectile 1.

Figure 6:
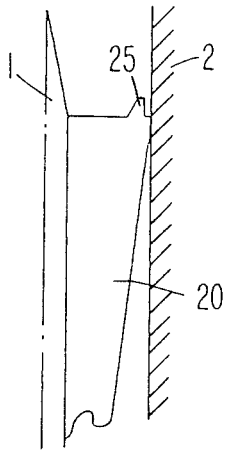
FIG. 6 is a lateral view of another embodiment of a plate-like component according to FIG. 5 with a flow-exposed surface at its front end face.

FIG. 6 shows a plate-shaped element 20 according to FIG. 5, wherein a nose-shaped extension 25 is molded in place in the guide zone 4. The extensions project in the forward direction out of the propulsion cage and constitute a flowexposed surface enhancing the detachment of the propulsion cage from the subcaliber projectile 1 after leaving the barrel. It is immediately apparent that the additional manufacturing cost for such an embodiment according to this invention is rather low.

What is claimed is:

1. A propulsion cage separated into segments and in shape-mating relationship to a subcaliber projectile, the propulsion cage including a forward guide zone and a propulsion zone with a driving surface, the driving surface has a continuously increasing contour extending substantially over an entire length of the subcaliber projectile from a rear end of the subcaliber projectile to the forward guide zone and wherein an area in which the propulsion cage is adapted to abut a barrel is disposed at a maximally forward position of the propulsion cage.

2. A propulsion cage according to claim 1, wherein the propulsion cage consists of a synthetic resin.

3. A propulsion cage according to claim 2, wherein the synthetic resin is an epoxy resin and the fibers are carbon fibers.

4. A propulsion cage according to one of claims 1 or 2, wherein the driving surface exhibits approximately a shape of a truncated cone.

5. A propulsion cage according to one of claims 1 or 2, further comprising guide means including ribs arranged on the driving surface in the propulsion zone.

6. A propulsion cage according to claim 1, wherein each segment includes a wedge-shaped cavity open in a firing direction, and cores filling the respective cavities.

7. A propulsion cage according to claim 6, wherein the cores include at least one of synthetic resin components with unidirectional fibers and molded compositions with chopped fibers.

8. A propulsion cage according to claim 6, wherein plate-shaped members are provided between the segments of the propulsion cage, and wherein a longitudinal axis of the subcaliber projectile lies in a plane of the plate-shaped members.

9. A propulsion cage according to claim 8, wherein the plate-shaped members between the segments are fashioned of a material with unidirectional fibers, and the cores include fiber-filled molded compositions.

10. A propulsion cage according to claim 8, wherein one of the plate-shaped members and the cores include nose portions extending out of the forward guide zone as flow-exposed surfaces.

11. A propulsion cage according to claim 2, wherein the synthetic resin is a fiber-reinforced synthetic resin.

* * * * *